US005384972A

United States Patent [19]

Arnt

[11] Patent Number: 5,384,972

[45] Date of Patent: Jan. 31, 1995

[54] PIN LOCK

[75] Inventor: Stanley L. Arnt, Watervliet, Mich.

[73] Assignee: Michigan Outdoor Products, Inc., Watervliet, Mich.

[21] Appl. No.: 33,295

[22] Filed: Mar. 17, 1993

[51] Int. Cl.[6] ..... A44B 9/02

[52] U.S. Cl. ..... 40/1.6; 24/711.1

[58] Field of Search ..... 40/1.5, 1.6, 663, 664, 40/665, 668, 316; 24/710.2, 708.6, 711.1, 709.7, 129 D

[56] References Cited

U.S. PATENT DOCUMENTS

| | | | |
|---|---|---|---|
| 849,558 | 4/1907 | Newman | 24/710.2 |
| 2,145,296 | 1/1939 | Draper et al. | 40/1.5 |
| 2,213,449 | 9/1940 | Mungen | 40/1.5 X |
| 2,292,140 | 8/1942 | Lofgren | 24/129 D |
| 2,341,773 | 2/1944 | Hanson | 40/664 X |
| 2,360,815 | 10/1944 | Mungen | 40/1.5 |
| 4,876,810 | 10/1989 | Piana et al. | 40/316 |

*Primary Examiner*—Peter R. Brown
*Assistant Examiner*—Joanne Silbermann
*Attorney, Agent, or Firm*—Flynn, Thiel, Boutell & Tanis

[57] ABSTRACT

A pin locking device for preventing an involuntary unlocking of a pin which is bent back on itself to form a spring, the pin having a pointed end section and a clasp mechanism mutually adjacent each other, the clasp mechanism retaining the pointed end section in a clasped condition against the urging of the spring. The pin locking device includes an elongated lock member having a body of a finite length made of a non-compressible material and having first and second spaced and parallel holes extending transversely through the body. An axially outwardly opening slot is provided in one end face of the lock member and extends entirely across the end face parallel to and opens into the first one of the transversely extending holes. The pointed end section of the pin extends through the second hole. The first hole receives therein a part of the pin extending between the clasp mechanism and the spring through the axially outwardly opening slot to thereby prevent the pointed end section of the pin from being able to move toward the aforesaid part of the pin between the clasp mechanism and the spring in order to effect an unclasping of the pointed end section from the clasp member.

6 Claims, 1 Drawing Sheet

PIN LOCK

FIELD OF THE INVENTION

This invention relates to a pin locking device and, more particularly, to a pin locking device for preventing an involuntary unlocking of a pin bent back on itself to form a spring, the pin having a pointed end section and a clasp mechanism mutually adjacent each other, the clasp mechanism retaining the pointed end section in a clasped condition against an urging of the spring.

BACKGROUND OF THE INVENTION

Those that hunt wild game are required by law to have fastened to the back surface of their clothing a hunting license that is to be displayed for the purpose of clearly indicating to others that the hunter is a licensed hunter. The hunting license is usually carried in some form of an envelope-like receptacle which has a clear plastic and transparent sidewall construction so that the license contained within the envelope-like receptacle is clearly visible through the transparent wall. The envelope-like receptacle is usually secured to a hunting jacket by a pin or by a plurality of pins. Unfortunately, as the hunter moves through brush and the like, the envelope-like receptacle becomes snagged on the brush and has a tendency to unfasten the pin or pins and become detached from the hunting jacket. In most instances, the hunting license becomes forever lost to the hunter.

Accordingly, it is an object of this invention to provide a pin locking device for preventing an involuntary unlocking of a pin.

It is a further object of the invention to provide a pin locking device, as aforesaid, wherein the pin locking device is used in association with a pin bent back on itself to form a spring, the pin having a pointed end section and a clasp mechanism mutually adjacent each other, the clasp mechanism retaining the pointed end section in a clasped condition against an urging of the spring.

It is a further object of the invention to provide a pin locking device, as aforesaid, wherein the pin locking device includes an elongated lock member having a body of a finite length, which body is made of a non-compressible rubber material and is adapted to be oriented between the pointed end section and a portion of the pin between the spring and the clasp so as to prevent the pointed end section from being able to move toward the aforesaid part of the pin between the clasp mechanism and the spring.

It is a further object of the invention to provide a pin locking device, as aforesaid, wherein an envelope-like holder device is suspended from the portion of the pin extending between the spring and the clasp when the pointed end section pierces a support surface and is in the clasped condition.

It is a further object of the invention to provide a pin locking device, as aforesaid, wherein the pin locking device is inexpensive to manufacture and is weather resistant so as to be durable and long lasting.

SUMMARY OF THE INVENTION

In general, the objects and purposes of the invention are met by providing a pin locking device including a pin which is bent back on itself to form a spring, the pin having a pointed end section and a clasp mechanism mutually adjacent each other, the clasp mechanism retaining the pointed end section in a clasped condition against the urging of the spring. The pin locking device includes an elongated lock member having a body of a finite length made of a non-compressible material and having first and second spaced and parallel holes extending transversely through the body. An axially outwardly opening slot is provided in one end face of the lock member and extends entirely across the end face and opens into the first one of the transversely extending holes. The pointed end section of the pin extends through the second hole. The first hole receives therein a part of the pin extending between the clasp mechanism and the spring through the axially outwardly opening slot to thereby prevent the pointed end section of the pin from being able to move toward the aforesaid part of the pin between the clasp mechanism and the spring in order to effect an unclasping of the pointed end section from the clasp member.

BRIEF DESCRIPTION OF THE DRAWINGS

Further objects and purposes of this invention will be apparent to persons acquainted with apparatus of this general type upon reading the following specification and inspecting the accompanying drawings, in which.

DETAILED DESCRIPTION

Figure 1:
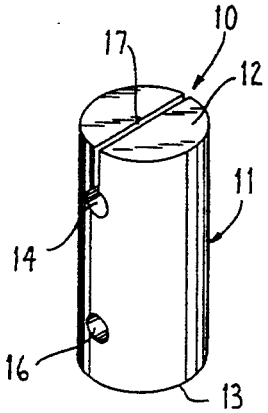
FIG. 1 is an isometric view of a pin locking device embodying the invention.

A pin locking device 10 embodying the invention is illustrated in FIG. 1. The pin locking device 10 10 includes, in this particular embodiment, a cylindrical body member 11 having opposite flat end surfaces 12 and 13 that are parallel to one another and extend in planes that are perpendicular to the longitudinal axis of the body member 11. A pair of holes 14 and 16 of equal diameter extend transversely through the body member 11, the axes of the holes 14 and 16 being generally perpendicular to the longitudinal axis of the body member 11 and intersecting the aforesaid longitudinal axis. A slot 17 is provided in the end face 12, extends on a diameter of the cylindrical body member 11 and parallel to the axis of the hole 14 and opens into the hole 14.

It is to be recognized that the pin locking device, and particularly the body member 11, can have other shapes, such as a solid rectangular shape without departing from the spirit of the invention.

Figure 4:
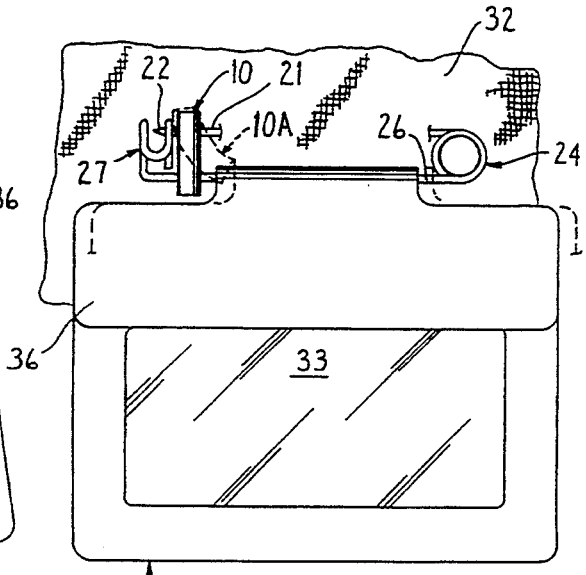
FIG. 4 is a front view of the envelope-like receptacle suspended from the pin when the pin is in the clasped condition and piercing a support surface.

The body member 11 is made of a hard rubber material that can be flexed so that the longitudinal axis becomes bent as illustrated in broken lines in FIG. 4, but the material is not compressible. The material of the body member 11 is also such that the width of the slot 17 can be elastically expanded to allow the passage therethrough of an elongated strand of wire larger in diameter than the width of the slot but equal to approximately the diameter of the hole, 14. The material of the body member 11 will elastically return to the condition illustrated in FIG. 1 following the passage of the strand of wire through the slot 17 as will be explained in more detail below. It is preferable that the pin locking device 10 having a Durometer hardness value of approximately 70.

Figure 2:
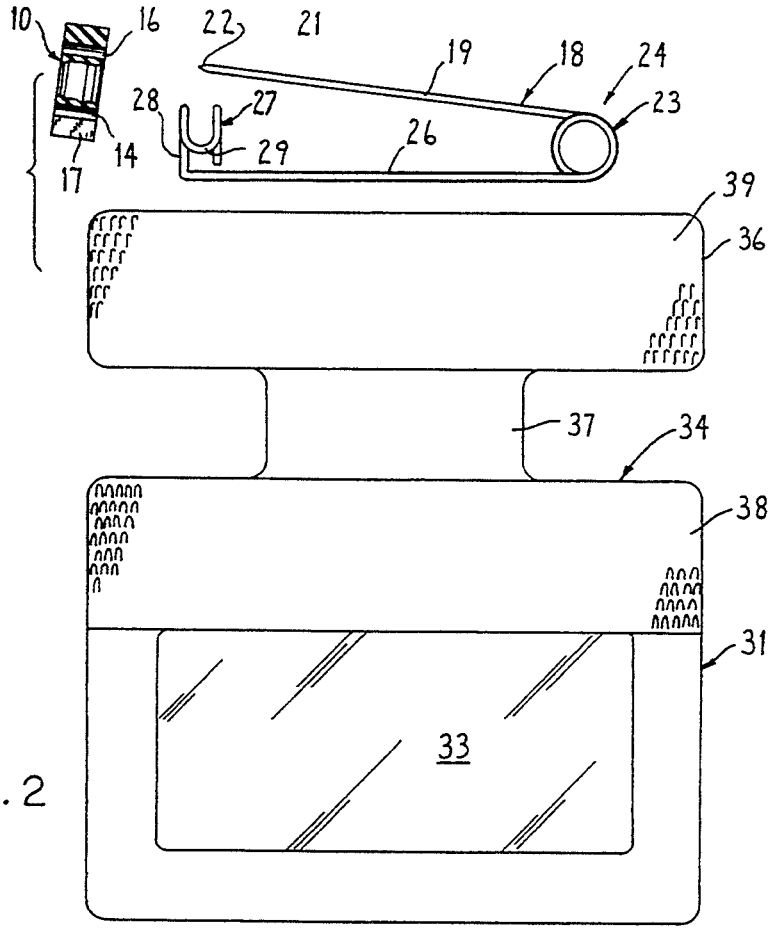
FIG. 2 is an exploded front view of the pin locking device, a pin and an envelope-like receptacle which is adapted to be suspended from the pin when the pin is in the clasped condition.
Figure 3:
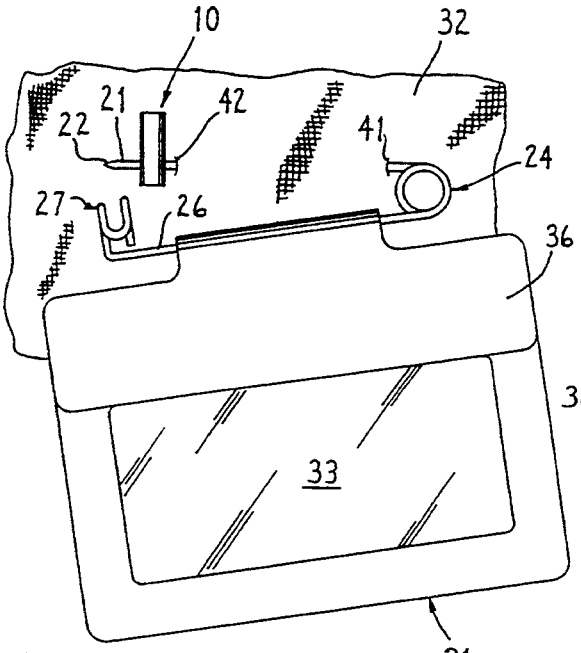
FIG. 3 is a front view of the envelope-like receptacle suspended from the pin when the pin is in the unclasped condition.

The pin locking device 10 is used in association with a pin 18 illustrated in FIG. 2. The pin 18 includes an elongated strand of wire 19 having an outer diameter generally equal to the inner diameter of the holes 14 and 16 in the pin locking device 10. The 10 elongated strand of wire 19 of the pin 18 includes a pointed end section 21 having a pointed end 22 at the distal end thereof. An intermediate segment of the wire strand 19 is bent into a circular coil as at 23 to form a spring 24. The end of the strand of wire 19 remote from the pointed end 22 and spaced from the spring 24 includes a generally straight support section 26 and a clasp section 27 at the distal end of the support section 26. The clasp section 27 includes a section of wire 28 that extends at a right angle to the support section 26. The clasp section 27 also includes a section of wire 29 that is bent back on the section 28 so as to define a cradle for the pointed end section 21 of the pin 18 when the pin is in the clasped condition as illustrated in FIG. 4. The unclasped position of the pin 18 is illustrated in FIGS. 2 and 3.

The pin 18 is used to support an envelope-like receptacle 31 on a support surface 32 as illustrated in FIG. 4. The envelope-like receptacle 31 includes a transparent window section 33 in one of the walls of the receptacle 31 so as to render visible anything that may be contained inside the envelope, such as a hunting license. The contents to be inserted into the receptacle 31 are introduced through an opening not shown but located at an edge 34 of the receptacle 31. The envelope-like receptacle 31 also includes a flap 36 that is integrally attached to a wall of the receptacle 31 that is opposite the window section 33 by a hinge section 37.

A surface of the wall of the receptacle 31 having the window section 33 thereon has a first part 38 of a two-part connecting structure secured thereto, which first part extends across the entire width of the envelope 31 as illustrated in FIG. 2. The second part 39 of the two-part connecting structure is secured to a surface on the flap 36 so that when the flap 36 is pivoted about the hinge section 37, the second part 39 becomes oriented in mutually opposed relation to the first part 38, and the two parts can thereafter be pushed into engagement with each other to effect a securement of the flap to the envelope-like receptacle 31.

The two parts of the connective arrangement 38 and 39 are of a VELCRO hook and loop fastener construction wherein one part consists of a plurality of hook-like members and the other part contains a plurality of loops with which the hooks engage when the two parts are connected together. As is illustrated in FIG. 2, the part 38 carries the plurality of loops whereas the part 39 carries the plurality of hook-like members. It is to be recognized that the orientation of the VELCRO construction can be reversed as desired.

The envelope-like receptacle 31 can be made by a variety of constructions. In this particular embodiment, the back wall of the receptacle 31 opposite the window section 33 and the flap 36 as well as the hinge section 37 are made of a first piece of material, such as sheet plastic or sheet rubber and the second wall of the envelope 31, namely the wall containing the window section 33, contains a second sheet of plastic or sheet rubber which is then secured by any convenient means, such as by sewing, to the back wall of the receptacle. Adhesives may also be used to effect the aforesaid securement. The VELCRO material can either be sewn to the material of the receptacle 31 and flap 36 or adhesively secured thereto as desired.

Referring now to FIGS. 3–4, the pointed end 22 first pierces a support surface 32 at two preferably horizontally spaced locations as at 41 and 42 so that the pointed end 22 is exposed to the left of the pierced location 42. Thereafter, the pointed end 22 is inserted through the hole 16 in the body 11 of the pin locking 10 device 10 and the body moved along the length of the section 21 to a position generally illustrated in FIG. 3 directly adjacent the pierced location 42 and above the support section 26. The slot 17 is oriented in alignment with the longitudinal axis of the support section 26 as illustrated in FIG. 4 and, as the pointed end section 21 is moved toward the support section 26, the pin locking device 10 will be allowed to flex to the broken line position 10A illustrated in FIG. 4 to allow the pointed end section 21 to move into a clasped relationship with the clasp section 27 as illustrated in FIG. 4. The clasp section 27 holds the pointed end section 21 in the clasp 27 against the urging of the spring 24. The material of the body member 11 of the pin locking device 10 is sufficiently yieldable to allow the width of the slot 17 to expand as the body member 11 is pushed to a straight orientation as illustrated in FIG. 4 so that the support section 26 of the pin 18 will be allowed to pass through the slot 17 and into the hole 14 of the body member 11. Following the entry of the section 26 of the pin 18 into the hole 14, the material of the body member 11 is sufficiently elastically yieldable so as to return to the original form thereof illustrated in FIG. 1 and in solid lines in FIG. 4. Since the material of the body member 11 is non-compressible, the pointed end section 21 will be prevented from moving toward the support section 26 in order to effect an involuntary unclasping of the clasped condition of the pin 18.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A pin locking device, comprising:

a pin having a strand bent back on itself to define spaced first and second strands and to form a spring therebetween, said pin having a pointed end section on said first strand and a clasp mechanism mutually adjacent said pin on said second strand, said clasp mechanism retaining said pointed end section in a clasped condition against an urging of the spring and when said first and second strands are generally parallel to one another;

an elongated flexible and noncompressible lock member having a body of finite length and means defining first and second spaced and parallel holes extending transversely through said body, said spacing between said holes being generally equal to said spacing between said first and second strands when they are generally parallel to one another, and means defining an axially outwardly opening slot extending entirely across one end face of said lock member and opening into said first transversely extending hole adjacent thereto, said one strand having said pointed end section of said pin thereon extending through said second hole, said body of said locking member being flexible about a longitudinal axis thereof to shorten an effective spacing between said second hole and said one end face so as to allow said first hole to receive therein said second strand of said pin between said clasp mechanism and the spring through said axially outwardly opening and aligned slot while said pointed end section is held by said clasp mechanism to thereafter prevent, following a return of said lock member to a nonflexed condition, the pointed end section of the pin from being able to involuntarily move toward said second strand of said pin between said clasp mechanism and the spring in order to effect an unclasping of said pointed end section from said clasp mechanism.

2. The pin locking device according to claim 1, wherein said lock member is made of a hard rubber material.

3. The pin locking device according to claim 1, wherein said lock member is made of hard rubber having a Durometer hardness value of approximately 70.

4. A pin locking device, comprising:

a pin having a strand bent back on itself to define spaced first and second strands and to form a spring therebetween, said pin having a pointed end section on said first strand and a clasp mechanism mutually adjacent said pin on said second strand, said clasp mechanism retaining said pointed end section in a clasped condition against an urging of the spring and when said first and second strands are generally parallel to one another;

an elongated flexible and noncompressible lock member having a body of finite length and means defining first and second spaced and parallel holes extending transversely through said body, said spacing between said holes being generally equal to said spacing between said first and second strands when they are generally parallel to one another, and means defining an axially outwardly opening slot extending entirely across one end face of said lock member and opening into said first transversely extending hole adjacent thereto, said one strand having said pointed end section of said Din thereon extending through said second hole, said body of said locking member being flexible about a longitudinal axis thereof to shorten an effective spacing between said second hole and said one end face so as to allow said first hole to receive therein said second strand of said pin between said clasp mechanism and the spring through said axially outwardly opening and aligned slot while said pointed end section is held by said clasp mechanism to thereafter prevent, following a return of said lock member to a nonflexed condition, the pointed end section of the pin from being able to involuntarily move toward said second strand of said pin between said clasp mechanism and the spring in order to effect an unclasping of said pointed end section from said clasp mechanism; and an envelope-like holder device having means defining a receptacle with an access opening thereinto and a means defining a cover for closing said access opening, said cover including a hinge means for securing said cover to said envelope-like receptacle, an exterior surface of said envelope-like receptacle having one part of a two-part fastener means secured thereto, a surface on said cover adapted to oppose said one part of said fastener means having a second part of said two-part fastener means secured thereto, said cover extending between through a space between said pointed end section of said pin and said part of said pin between said clasp mechanism and the spring so that when said two-part fastener means is fastened together, said hinge means and said part of said pin between said clasp mechanism and the spring will be mutually adjacent and parallel to one another, and envelope-like receptacle will be hung from said pin when said pointed end section pierces a support surface and is in said clasped condition.

5. The pin locking device according to claim 4, wherein each part of said two-part fastener means includes hook and loop fastener means adapted to be mutually coupled together.

6. The pin locking device according to claim 1, wherein said body member is cylindrical in shape and the end face is flat and oriented in a plane that is perpendicular to a longitudinal axis of the body member.

* * * * *

UNITED STATES PATENT AND TRADEMARK OFFICE

CERTIFICATE OF CORRECTION

PATENT NO. : 5 384 972

DATED : January 31, 1995

INVENTOR(S) : Stanley L. Arnt

It is certified that error appears in the above-indentified patent and that said Letters Patent is hereby corrected as shown below:

Column 5, line 45; change "Din" to ---pin---.

Signed and Sealed this

Thirtieth Day of May, 1995

*Attest:*

Bruce Lehman

BRUCE LEHMAN

*Attesting Officer*

*Commissioner of Patents and Trademarks*